US005122840A

United States Patent [19]

Maeyama

[11] Patent Number: 5,122,840

[45] Date of Patent: Jun. 16, 1992

[54] COPYING METHOD AND COPYING APPARATUS FOR OBTAINING COLLATED DUPLEX COPIES FROM DUPLEX DOCUMENTS

[75] Inventor: Kazuo Maeyama, Nara, Japan

[73] Assignee: Sharp Kabushiki Kaisha, Osaka, Japan

[21] Appl. No.: 425,330

[22] Filed: Oct. 23, 1989

[30] Foreign Application Priority Data

Oct. 25, 1988 [JP] Japan ..... 63-270296

[51] Int. Cl.[5] ..... G03G 21/00

[52] U.S. Cl. ..... 355/320; 355/318; 355/319

[58] Field of Search ..... 355/319, 320, 318, 278, 355/23, 24; 271/291

[56] References Cited

U.S. PATENT DOCUMENTS

| | | | |
|---|---|---|---|
| 4,099,150 | 7/1978 | Connin | 355/319 |
| 4,319,833 | 3/1982 | Hidding | 355/23 |
| 4,368,973 | 1/1983 | Silverberg | 355/318 X |
| 4,674,866 | 6/1987 | Tanaka | 355/319 X |
| 4,699,365 | 10/1987 | Smith et al. | 355/320 X |
| 4,825,245 | 4/1989 | Fukae et al. | 355/319 X |
| 4,903,085 | 2/1990 | Ikeda et al. | 355/320 |
| 5,016,061 | 5/1991 | Tashiro et al. | 355/320 |

*Primary Examiner*—A. T. Grimley
*Assistant Examiner*—Nestor R. Ramirez

[57] ABSTRACT

A copying apparatus is provided which makes collated duplex copies from the duplex original documents, first one side is copied by a necessary number of sheet, and then the other side is copied. The originals are put on a recirculating automatic document feeder with one side faced down, and are directly sent into the exposure region in the same face-back relation when copying the first set, and are inverted after exposure and returned. When copying the second and subsequent sets, the originals are inverted and conveyed into the exposure region, and are inverted after exposure and returned. When copying the final set, the originals are inverted and conveyed into the exposure region, and are directly returned in the same face-back relation, so that they are stacked up with the other side faced up. Therefore, when copying the other side, the originals are inverted and conveyed into the exposure region, and are inverted after exposure and returned. In this way, the switch-back route for conveying the originals while maintaining the face-back relation is used only twice, and the original feed speed is increased. Besides, it is not necessary to move the originals only for the purpose of inverting their sides, and the time required for copying operation is shortened.

11 Claims, 9 Drawing Sheets

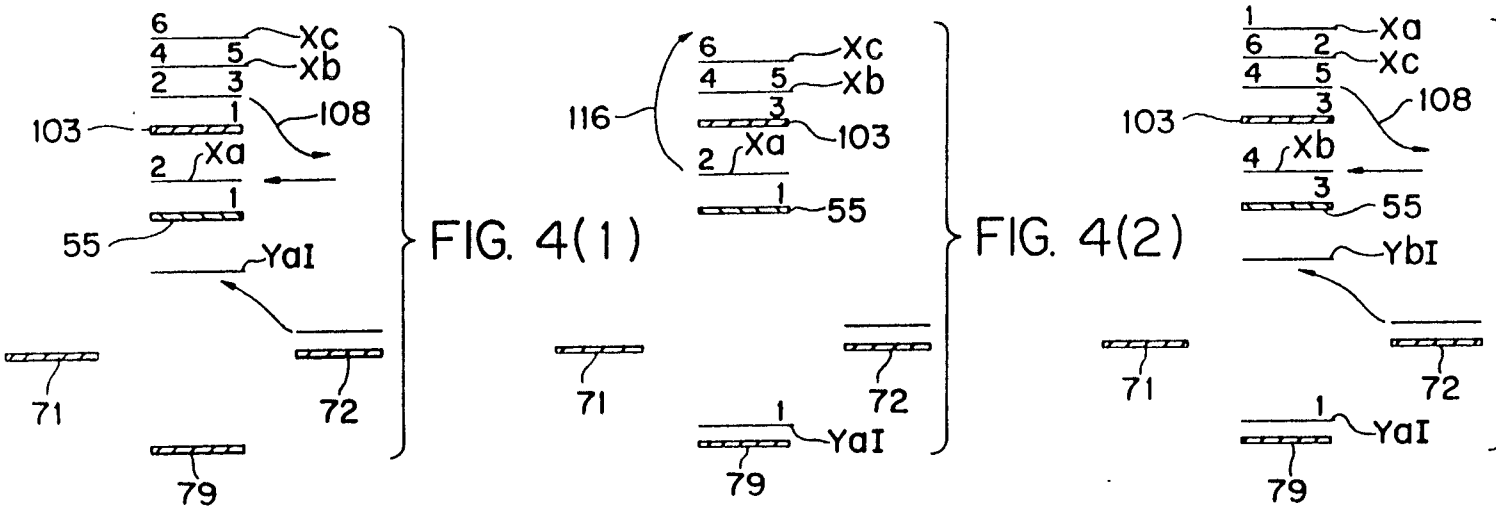
FIG. 4(1)
FIG. 4(2)
FIG. 4(3)
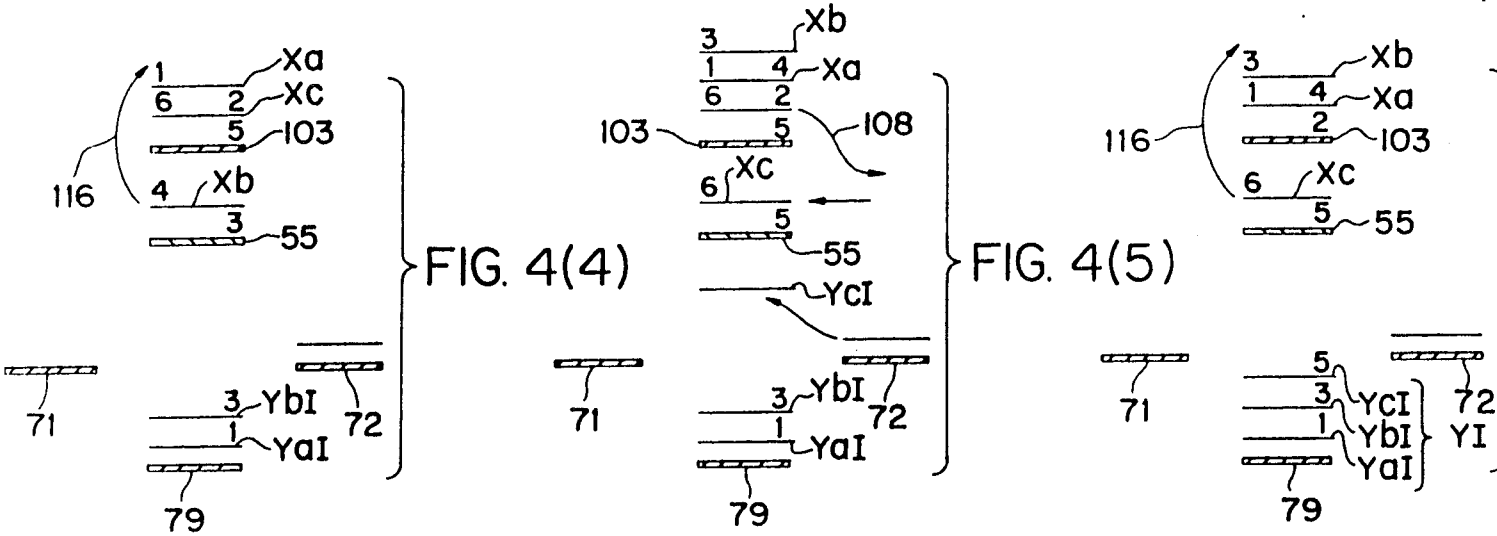
FIG. 4(4)
FIG. 4(5)
FIG. 4(6)

Xa
Xb
Xc
YaII
YbII
YcII
YI
YII
103
107
116
55
71
72
79

Xa
Xb
Xc
YaIII
YbIII
YcIII
YI
YII
YIII
103
107
117
55
71
72
79

Xa
Xb
Xc
YaI
YbI
YcI
YII
YIII
WI
103
107
116
55
71
72
79

Xa
Xb
Xc
YaII
YbII
YcII
YIII
WI
WII
WIII
103
107
116
55
71
72
79

Xa
Xb
Xc
107
107III
103
55
116
YaIII
YbIII
YcIII
WI
WII
WIII
71
72
79

COPYING METHOD AND COPYING APPARATUS FOR OBTAINING COLLATED DUPLEX COPIES FROM DUPLEX DOCUMENTS

BACKGROUND OF THE INVENTION

1. Field of the Invention

The present invention relates to a copying method and a copying apparatus for obtaining collated duplex copies from duplex documents which is particularly advantageous for obtaining two or more copies from a plurality of duplex documents.

2. Description of the Prior Art

U.S. Pat. No. 4,099,150 discloses a copying apparatus capable of obtaining duplex copies collated in page sequence from a plurality of duplex documents. In this copying apparatus, when obtaining collated duplex copies from a plurality of duplex documents, after copying one side of all duplex original documents, the other side is copied.

The original feeder of this copying apparatus comprises two original hoppers, and the duplex documents are first put on a first original hopper. When copying one side of the duplex documents, the duplex documents are moved from the first original hopper to a second original hopper, and are supplied from the second original hopper into an exposure region by circulation. When copying of one side of duplex documents is over, the duplex documents are moved from the second original hopper into the first original hopper in order to be turned upside down, and are further moved from the first original hopper into the second original hopper. In this way, the duplex documents turned upside down are supplied again into the exposure region by circulation, and the other side is copied.

In such copying apparatus, aside from the circulation of the documents for copying action, the movement of the documents from the first original hopper into the second original hopper upon start of copying, and the movement for inverting the face-back relation after copying of one side are needed, and requires an enormous time until copying of a plurality of duplex documents is.

SUMMARY OF THE INVENTION

It is a primary object of the invention to present a method and a copying apparatus for obtaining collated duplex copies from a plurality of duplex documents in a shortened time.

The invention relates to a copying method for obtaining collated duplex copies from duplex originals for copying one side of duplex originals by a desired number of copies, and then copying the other side of duplex originals by the same number of copies, comprising the steps of:

supplying a plurality of sets of duplex originals in either top-bottom direction or bottom-top direction for copying, exposing without inverting the face-back relation of the supplied duplex originals when copying the first set, and returning in the other direction by inverting the face-back direction of the duplex originals after exposing, supplying the duplex originals, inverting the face-back relation, exposing, and then inverting the face-back relation and returning, copying thus one side of duplex originals to one side of copying papers, and returning the originals without inverting the face-back relation after completion of exposure of the final set of the duplex original, and supplying duplex originals in the first direction for copying the other side of the duplex originals, inverting the face-back relation, exposing, and then inverting the face-back relation of the duplex originals after exposure to return to the initial state.

The invention also relates to a copying apparatus for obtaining collated duplex copies from duplex originals, comprising:

means for storing a plurality of sets of duplex originals stacked up in the page sequence from bottom to top, means for feeding originals one by one from the storing means, means for exposing the originals, first conveying means for conveying the originals into the exposure region while maintaining the face-back relation, being installed between the feeding means and exposure means, first inverting means for inverting the face-back relation of the originals to convey into the exposure region, being installed between the feeding means and exposure means, second inverting means for inverting the face-back relation to return the originals exposed in the exposure region to the top of the storing means, second conveying means for returning the originals exposed in the exposure region to the top of the storing means by inverting the face-back relation, means for feeding copying papers, means for copying the exposed original images onto copying papers, means for storing the copying papers after copying directly in the same face-back relation, means for conveying the copying papers from the copying paper storing means into the copying means by inverting the face-back relation, and means for controlling so as to feed the copying papers from the copying paper feeding means when copying one side of the originals and store the copying papers after copying in the copying paper storing means, feed the copying papers from the copying paper storing means when copying the other side of the originals, lead the originals fed from the storing means into the exposure region through the first conveying means when copying the first set of one side of the originals and return the originals after exposure to the storing means through the second converting means, lead the originals fed from the storing means into the exposure region through the first inverting means when copying the final set of one side of the originals and return the originals after exposure to the storing means through the second conveying means, and lead the originals fed from the storing means into the exposure region through the first inverting means when copying other than the first set and final set of one side of the originals and when copying the other side of the originals and return the originals after exposure into the storing means through the second inverting means.

The first conveying means of the invention comprises:

a first conveying member for conveying the originals from the paper feeding means, means for pooling the originals, and a second conveying member for conveying the originals from the original pooling means into the exposure region:

The first conveying means further comprises:

means for orienting by guiding the originals from the paper feeding means into the original pooling means, and guiding the originals from the original pooling means into the exposure region.

The first inverting means of the invention comprises:

means for guiding the originals from the paper feeding means by curving, and a pair of rollers for conveying the originals.

The paper feeding means of the invention comprises:

means for orienting by guiding the originals from the storing means into the first conveying means or first inverting means.

The second conveying means of the invention comprises:

a first conveying member for conveying the originals from the exposure region, means for pooling the originals, and a second conveying member for conveying the originals from the original pooling means into the storing means.

The second conveying means further comprises:

means for orienting by guiding the originals from the exposure region into the original pooling means, and guiding the originals from the original pooling means into the storing means.

The second inverting means of the invention comprises:

means for guiding the originals from the exposure region by curving, and a pair of rollers for conveying the originals.

The copying apparatus of the invention further comprises:

means for orienting by guiding the originals from the exposure region into the second conveying means or second inverting means.

The copying means of the invention comprises:

means for converting the original image after exposure into a toner image and bringing it into a transfer region, means for conveying the copying paper into the transfer region for fixing the toner image, and means for discharging the copying paper from the transfer conveying region.

According to the invention, sets of duplex originals are supplied in one direction, either from top to bottom or from bottom to top. When copying one side of the first set, the supplied duplex originals are exposed while maintaining the same face-back relation, and the duplex originals after exposure are inverted in the face-back relation, and are returned in the other direction. That is, the originals are stacked up with one side to be exposed faced upward. Therefore, when copying one side after the second set, the supplied duplex originals are exposed in the inverted face-back relation, and the duplex originals after exposure are returned after the face-back relation is inverted. In this way, one side of the duplex originals is copied on one side of copying papers, and after completion of exposure of one side of the final set, the duplex originals are returned while maintaining the same face-back relation. The duplex originals are stacked up with the other side surface faced upward.

Next, when copying the other side of the duplex originals, the stacked originals are fed in the one direction. The supplied duplex originals are inverted in the face-back relation, and the other side is exposed, and the duplex originals after exposure are returned in the inverted face-back relation. In this way, from the first set to the final set, the other side is exposed, and the copies are made on the other side of the copying papers.

Therefore, the inverting action of the face-back relation of the originals for exposing the other side is done when returning the originals after completion of the exposure of the final set of one side, and the number of recirculations of the originals is decreased. Besides, inversion of the conveying direction for conveying while maintaining the face-back relation of the originals is done only when copying the first set and final set of one side, so that the original feeding speed is enhanced.

Thus, according to the invention, the time required for producing collated duplex copies from a plurality of duplex documents is shortened, and the convenience of the copying apparatus may be enhanced.

BRIEF DESCRIPTION OF THE DRAWINGS

These and other objects of the invention, as well as the features and advantages thereof will be better understood and appreciated from the following detailed description taken in conjunction with the drawings, in which.

DETAILED DESCRIPTION OF THE PREFERRED EMBODIMENT

Figure 1:
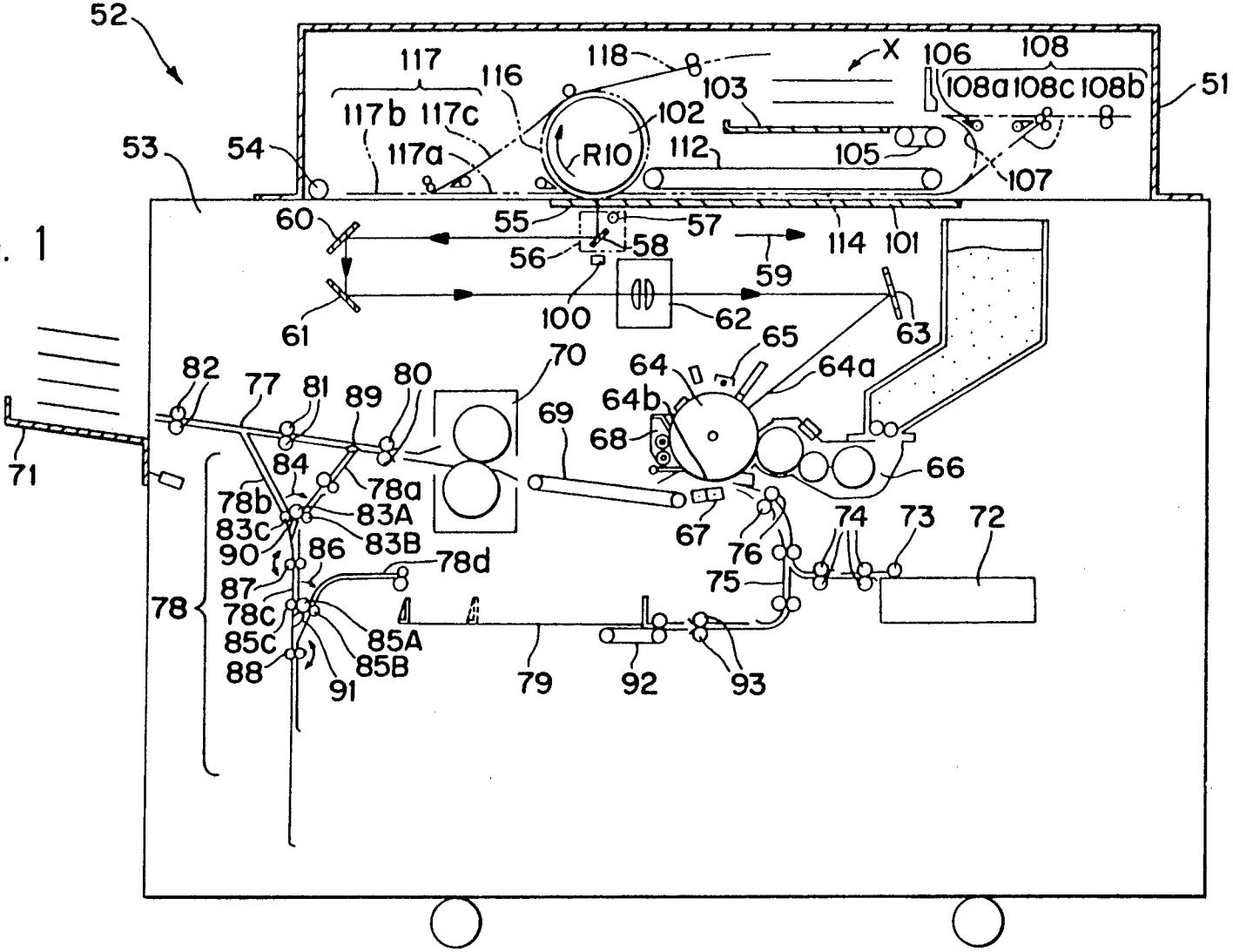
FIG. 1 is a sectional view showing a basic structure of a copying apparatus 52 comprising a recirculating automatic original feeder (RADF) 51.

Referring now to the drawings, one of the preferred embodiments of the invention is described in detail below.

FIG. 1 is a sectional view showing a basic structure of an electrostatic copying apparatus 52 comprising RADF 51.

The RADF 51 is mounted on the top of the copying apparatus main body 53 angularly dislocatably with respect to a rotary shaft 54. On the top of the copying apparatus main body 53, there is an original platen 55 made of hard glass or similar material. When the original document X is not fed by the RADF 51 (for example, when the original document X is a book), the document X is put on the original platen 55 with the copy side down, and the document X is pressed and fixed against the original platen 55 beneath the RADF 51, and the copying operation is done in this state.

Inside the copying apparatus main body 53, exposure means 56 is provided so as to be conveyed in the range of the installation of the original platen 55 at a position close to the original platen 55, extending in the direction perpendicular to the sheet of paper in FIG. 1. The exposure means 56 contains a copy lamp 57 for example halogen lamp or the like, and a reflector 58. The exposure means 56 is conveyed by a mechanism not shown in the drawing in the direction of arrow 59 when scanning the document X in the state of the document X being stopped on the original platen 55, and the original plane is scanned and exposed in this state.

The light generated from the copy lamp 57 is selectively absorbed in response to the original image on the original plane. The reflected light from the original plane is led into an exposure region 64*a* of a right cylindrical photosensitive drum 64 having an axial line parallel to the longitudinal direction of the exposure means 56, being located near the middle of the inside of the copying apparatus main body 53, by means of reflectors 60, 61, zoom lens 62, and reflector 63, from the reflector 58. When the exposure means 56 is conveyed, the reflectors 60, 61 are also conveyed at the same time, and the length of the optical path from the exposure means 56 up to the exposure region 64*a* of the photosensitive drum 64 is kept constant.

The surface of the photosensitive drum 64 before exposure at the photosensitive drum 64 is uniformly charged by a corona discharger for charging 65 disposed along the outer circumference of the photosensitive drum 64, being extended in the axial direction of the photosensitive drum 64. When the surface of such photosensitive drum 64 is illuminated with the reflected light from the original plane as mentioned above, the surface of the photosensitive 64 is selectively destaticized, and an electrostatic image is formed in this way. This electrostatic image is made sensible into a toner image by a developing apparatus 66, and this toner image is transferred onto the copying paper after being conveyed by the structure described later near the transfer region 64*b* by the function of the corona discharger for transfer 67.

The toner remaining on the surface of the photosensitive 64 after transfer of the toner image is removed by a cleaning apparatus 68. The copying paper after transfer of the toner image is led into a fixing apparatus 70 by means of conveying belt 69, and the toner image is heated and fixed by this fixing apparatus 70. The copying paper passing through the copying process in this way is discharged onto a paper discharge tray 71 installed at one side of the copying apparatus main body 53 in the manner described below.

In the copying apparatus main body 52, a paper feeding tray 72 containing plural copying papers is installed. The copying papers contained in the paper feeding tray 72 are taken out one by one by a paper feed roller 73 which is rotated and driven in a state being pressed against the top sheet of the stack of copying papers, and are sent into the paper feed route 75 by means of conveying roller 74. Near the transfer region 64*b* of the paper feed route 75, a pair of resist rollers 76 are provided, and these resist rollers 76 are coupled to the driven shaft of drive means which is not shown inside the copying apparatus main body 53 by way of a clutch not shown. By the on/off control of the clutch, the copying paper can be transferred in synchronism with the toner image formed on the surface of the photosensitive drum 64.

Branching off from the discharge route 77 leading to the paper discharge tray 71 from the outlet of the fixing apparatus 70, an inverting route 78 is provided. This inverting route 78 is composed of first and second route 78*a*, 78*b* branching off at mutually different positions from the upstream side of the conveying direction of the copying paper of the discharge route 77, a third route 78*c* extending downward from the converging part of the first and second routes 78*a*, 78*b*, and a fourth route 78*d* branching off from the third route 78*c* and reaching up to an intermediate tray 79. In relation to the discharge route 77, pairs of conveying rollers 80, 81, 82 are disposed at a spacing.

In the inverting route 78, in relation to the converging position of the first and second routes 78*a*, 78*b*, a roller 83A is disposed, and rollers 83B, 83C commonly connected to this roller 83A are disposed in relation to the first and second routes 78*a*, 78*b*, respectively. The roller 83A is rotated and driven in the direction of arrow 84, which makes it possible to convey the copying paper from the first route 78*a* to the third route 78*c*, and from the third route 78*c* to the second route 78*b*. Moreover, in relation to the position of branching of the fourth route 78*d* from the third route 78*c*, a roller 85A is disposed, and rollers 85B, 85C commonly contacting with the roller 85A are disposed in relation to the fourth and third routes 78*d*, 78*c*, respectively. The roller 85A is rotated and driven in the direction of arrow 86, which makes it possible to convey the copying paper in the direction perpendicularly downward near the roller 85C, and also to convey in the direction toward the intermediate tray 79 inside the fourth route 78*d*.

At the third route 78*c* near the converging position of the first and second routes 78*a*, 78*b*, a conveying roller 87 rotating in normal and reverse directions is disposed, and another conveying roller 88 rotating in normal and reverse directions is disposed in the third route 78*c* at the lower side of the position near the branching position of the fourth route 78*d* from the third route 78*c*. Furthermore, near the branching position of the first route 78*a* from the discharge route 77, a gate flapper 89 for selectively leading the copying paper from the fixing apparatus 70 to the discharge route 77 or first route 78*a* is disposed, and at the converging position of the first and second routes 78*a*, 78*b*, a gate flapper 90 for securely leading the copying paper from the third route 78*c* to the second route 78*b* is disposed, and at the branching position of the fourth route 78*d* from the third route 78*c*, a gate flapper 91 for securely leading the copying paper from the third route 78*c* to the fourth route 78*d* is disposed.

The copying paper stacked on the intermediate tray 79 has a copy image formed on its upper side. Such copying paper is taken out one by one a paper feed belt 92 from the stack of recording papers placed at the bottom side, and is led into the paper feed route 75 by means of conveying roller.

The copying paper from the fixing apparatus 70 is able to be discharged in the following three manners.

1. To be discharged directly onto the paper discharge tray 71 by way of the discharge route 77.

2. To be led into the discharge route 77 again from the discharge route 77 through the first route 78*a*, third route 78*c*, and second route 78*b*, so as to be inverted, and discharged onto the paper discharge tray 71.

3. To be once stacked up on the intermediate tray 79 from the discharge route 77 through the first route 78*a*, third route 78*c*, and fourth route 78*a*, and led to the vicinity of the transfer region 64*b* of the photosensitive drum 64 through the paper feed route 75, and passed again through the fixing apparatus 70, and led into the discharge route 77 again from the discharge route 77 through the first route 78*d*, third route 78*c*, and second route 78*b*, and discharged onto the discharge tray 71.

Such discharge modes 1 to 3 of the copying paper are selected corresponding to the copy mode entered by the operator from the operation unit, not shown, installed in the copying apparatus main body 53. Plural detectors (not shown) are disposed at proper positions in the conveying route of the copying paper in the copying apparatus main body 53, and by detecting the copying paper by these detectors, the conveying rollers and gate flappers are driven, thereby realizing the conveying modes of the copying paper as described above.

Figure 2:
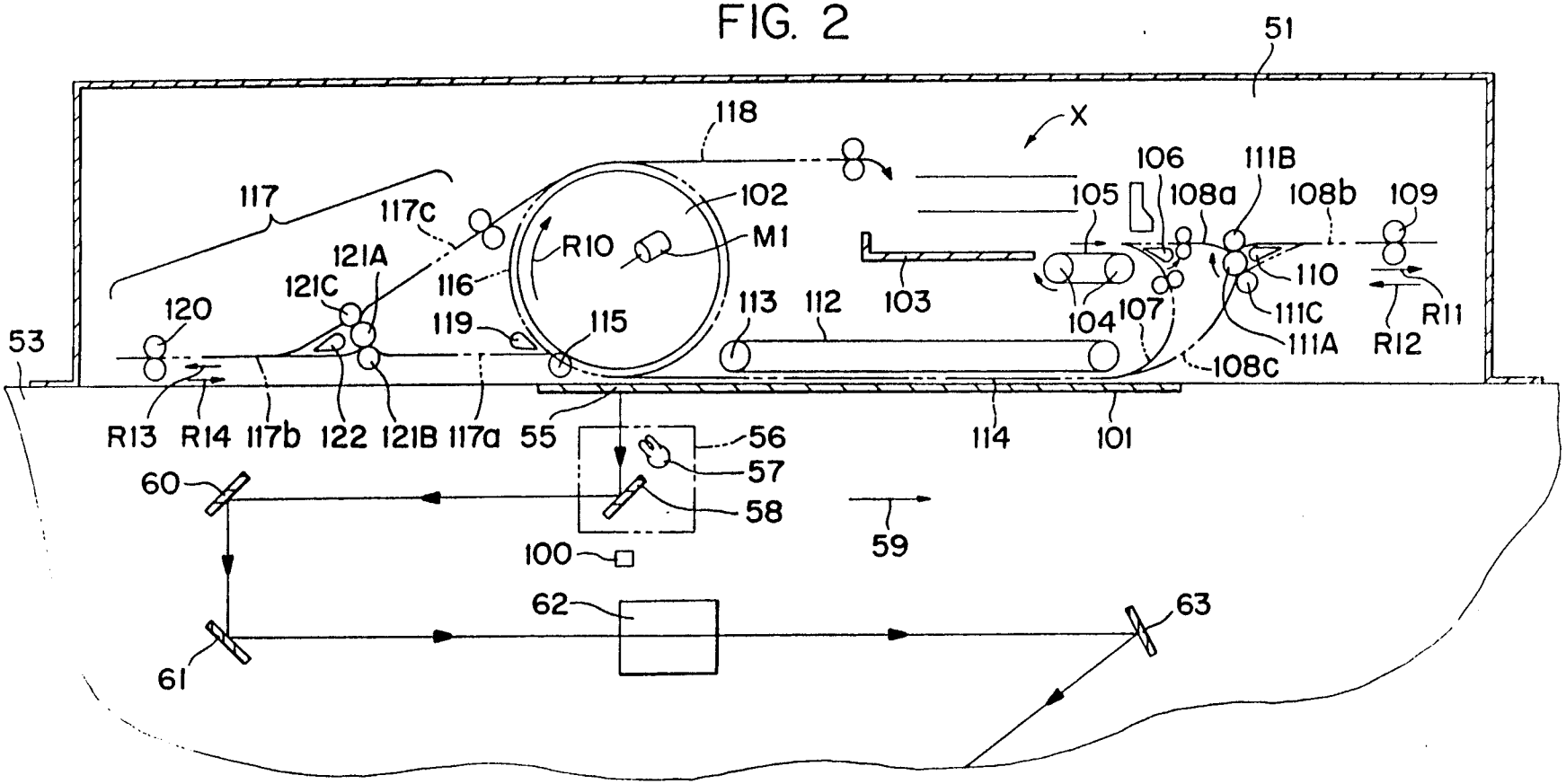
FIG. 2 is a sectional view showing a basic structure of the RADF 51.

FIG. 2 is an enlarged sectional view of the structure of the RADF 51. When copying by using this RADF 51 while conveying the sheet originals, the exposure means 56 is detected by a sensor 100, and the exposure means 56 is stopped at a position relating to the exposure region 101 commonly shown in FIGS. 1 and 2. In the RADF 51 at a position corresponding to the upper side of the exposure region 101, an original drum 102 of right cylindrical shape possessing an axial line vertical to the sheet of paper in FIGS. 1 and 2 is provided. This original drum 102 is rotated and driven in the direction of arrow R10 by a motor M1.

In the RADF 51, a plurality of sheet documents X are put on the original hopper 103 which is an original storing means. Relating to the original hopper 103, there is a paper feed belt 105 which is the feeding means wound on a driving roller 104 being rotated and driven in the direction of arrow as the torque of the motor M1 is transmitted through the clutch. By the paper feed belt 105, the bottom side sheet documents X in the original hopper 103 of the plurality of sheet documents X is drawn out.

The drawn sheet documents X is selectively led into the first conveying route 107 which is a first inverting means or second conveying route 108 which is a first conveying means by means of a gate flapper 106 driven by the solenoid. That is, while the solenoid is de-excited, the gate flapper 106 closes the second conveying route 108, and opens the first conveying route 107. When the solenoid is excited, the gate flapper 106 is angularly dislocated, and the first conveying route 107 is closed, while the second conveying route 108 is opened.

The first conveying route 107 is extending in the widthwise direction of the sheet documents X (in the direction vertical to the sheet of paper in FIGS. 1 and 2), and there is a semicircumferential-shaped section vertical to the longitudinal direction, and the sheet documents X drawn out by the paper feed belt 105 is led into the vicinity of the original platen 55.

The second conveying route 108 comprises a first route 108*a* extending in the horizontal direction from the original hopper 103, a second route 108*b* continuous with this first route 108*a*, and a third route 108*c* converging with the first route 108*a* near the original platen 55, branching off from the second route 108*b*. In the second route 108*b*, there is a conveying roller 108 which is driven and rotated in normal and reverse directions as the torque of the motor M11 is transmitted, so that the sheet documents X are conveyed in the direction of arrows R11, R12 in the second route 108*b*.

Relating to the position where the third route 108*c* is branched off from the second route 108*b*, there is a gate flapper 110 for leading the sheet documents X led into the second route 108 securely into the third route 108*c*. Relating to this position, moreover, a roller 111A is disposed, and rollers 111B, 111C commonly contacting with the roller 111A are disposed in relation to the first and third routes 108*a*, 108*c*, respectively. While the solenoid is de-excited, the line between the first route 108*a* and second route 108*b* is released, and when it is excited, the gate flapper 110 is angularly dislocated, and the line between the first and second routes 108*a*, 108*b* is closed, while the line between the second and third routes 108*b*, 108*c* is widely opened.

The sheet documents X led into the vicinity of the original platen 55 from the first conveying route 107 or the third route 108*c* of the second conveying route 108 are conveyed in the conveying route 114 formed between the conveying belt 112 and the original platen 55, by means of the conveying belt 112 disposed in relation to the original platen 55. This conveying belt 112 is wound on a driving roller 113 to which is transmitted the torque of the motor M11 through an unshown structure.

The sheet documents X lead to the vicinity of the exposure region 101 by the conveying belt 112 is held between the original drum 102 and the driven roller 115 contacting with the original drum 102, and is conveying as being wound on the original drum 102.

Near the driven roller 115, the conveying route of the sheet document X is branched off into the third conveying route 116 which is a second inverting means and fourth conveying route 117 which is a second conveying means. The third conveying route 116 is the way along the outer circumference of the exposure drum 102, and is continuous to the conveying route 118 consecutive to the upper side of the original hopper 103.

The fourth conveying route 117 is composed of a first route 117*a* branched off in the horizontal direction near the dirven roller 115 from the third conveying route 116, a second route 117*b* extending continuously with the third route 117*a*, and a third route 117*c* branching off from the second route 117*b*, converging with the third conveying route 116, and continuous with the conveying route 118. At the position where the first route 117*a* is branched off the third conveying route 116, there is a gate flapper 119 which is driven by solenoid to selectively lead the sheet documents X led in from the exposure region 101 into the fourth conveying route 116 or third conveying route 117 depending on excitation or de-excitation of the solenoid. In the second route 117*b*, there is a conveying roller 120 which is rotated as the torque of the motor M11 is transmitted through clutch, so that the sheet documents X in the second route 117*b* are conveying in the direction of arrows R13, R14.

Relating to the position where the third route 117*c* is branched off the second route 117*b*, a driving roller 121A is disposed, and rollers 121B, 121C commonly contacting with the driving roller 121A are disposed in relation to the first and third routes 117*a*, 117*c*, respectively. At the branching part, moreover, a gate flapper 122 which is driven by a solenoid is installed, so that the sheet documents X may be securely led in from the second route 117*b* into the third route 117*c*. While the solenoid is de-excited, the line between the first and second routes 117*a*, 117*b* is opened, and when the solenoid is excited, the gate flapper 122 is angularly dislocated, and the line between the first and second routes 117*a*, 117*b* is closed, while the line between the second and third routes 117*b*, 117*c* is widely opened.

Figure 3:
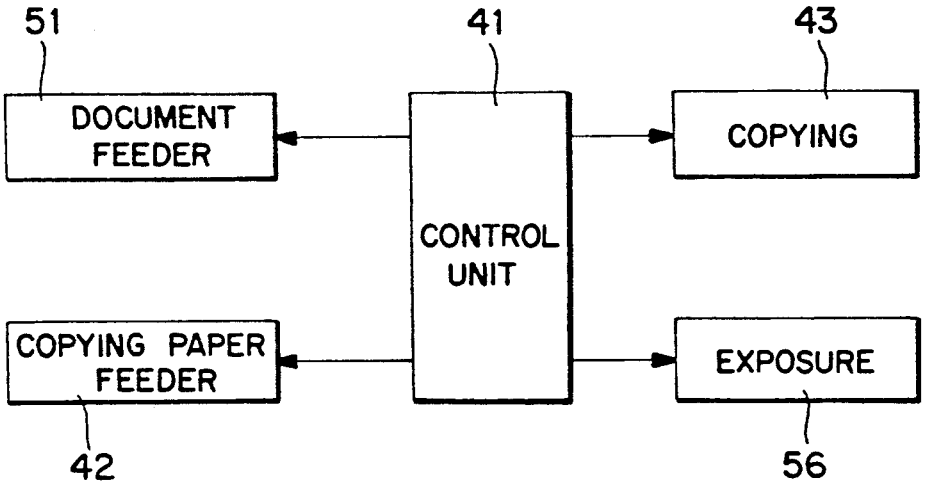
FIG. 3 is a block diagram showing an electrical composition of a copying apparatus 52.

FIG. 3 is a block diagram showing a basic electrical composition of a copying apparatus 52. A control unit 41 controls copying means 43 comprising a paper feeding tray 72 and an intermediate tray 79, a document feeder 51, and exposure means 56. It is controlled by the control unit 41 so that the conveying timing of the document X by the document feeder 51 and the conveying timing of the copying paper by the copying paper feeder 42 may be synchronized. Depending on the conveying timing, the exposure means 56 and copying means 43 are controlled.

Figure 4:
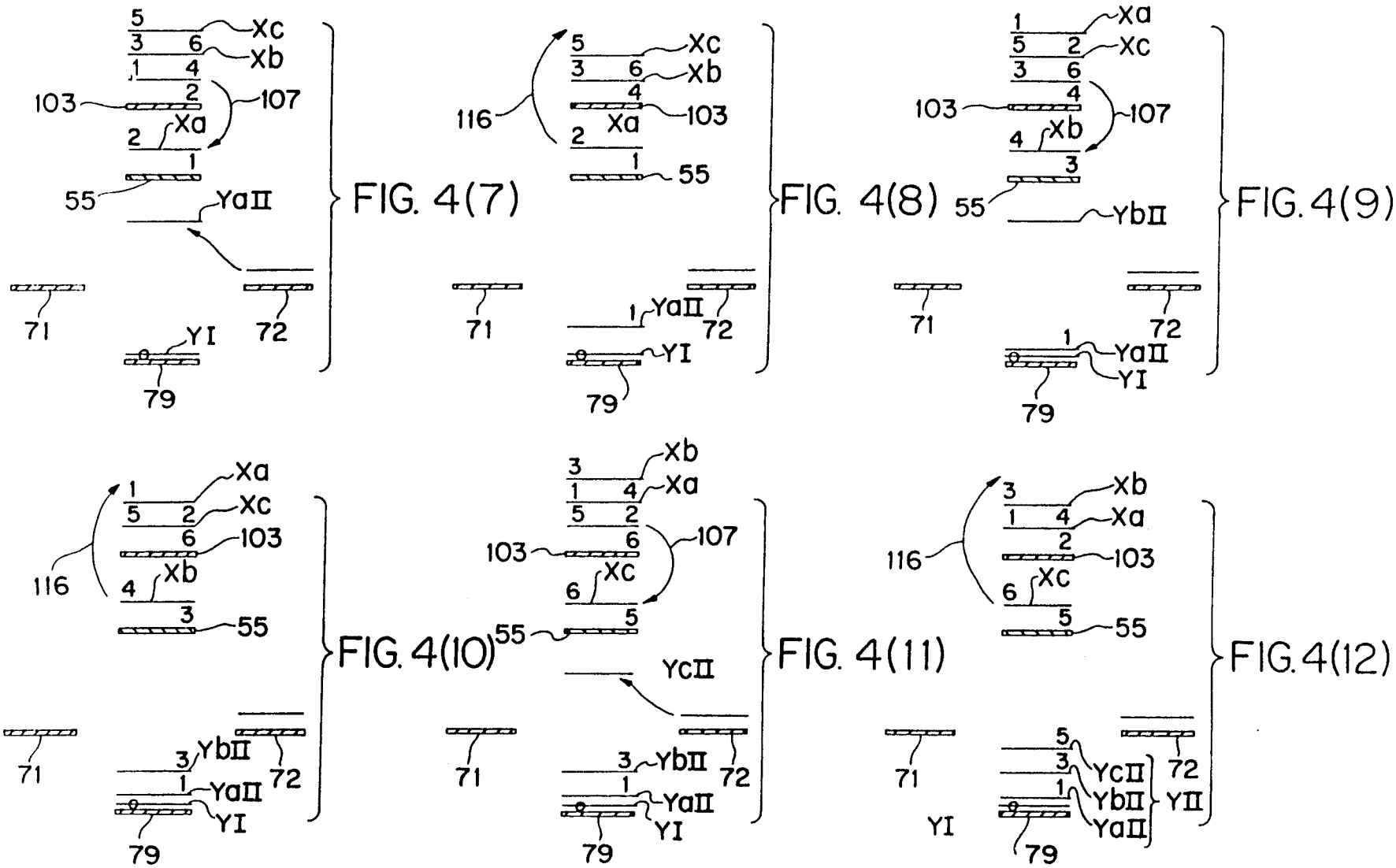
FIG. 4 is a simplified sectional view for explaining the copying action in one of the embodiments of the invention.
Figure 4:
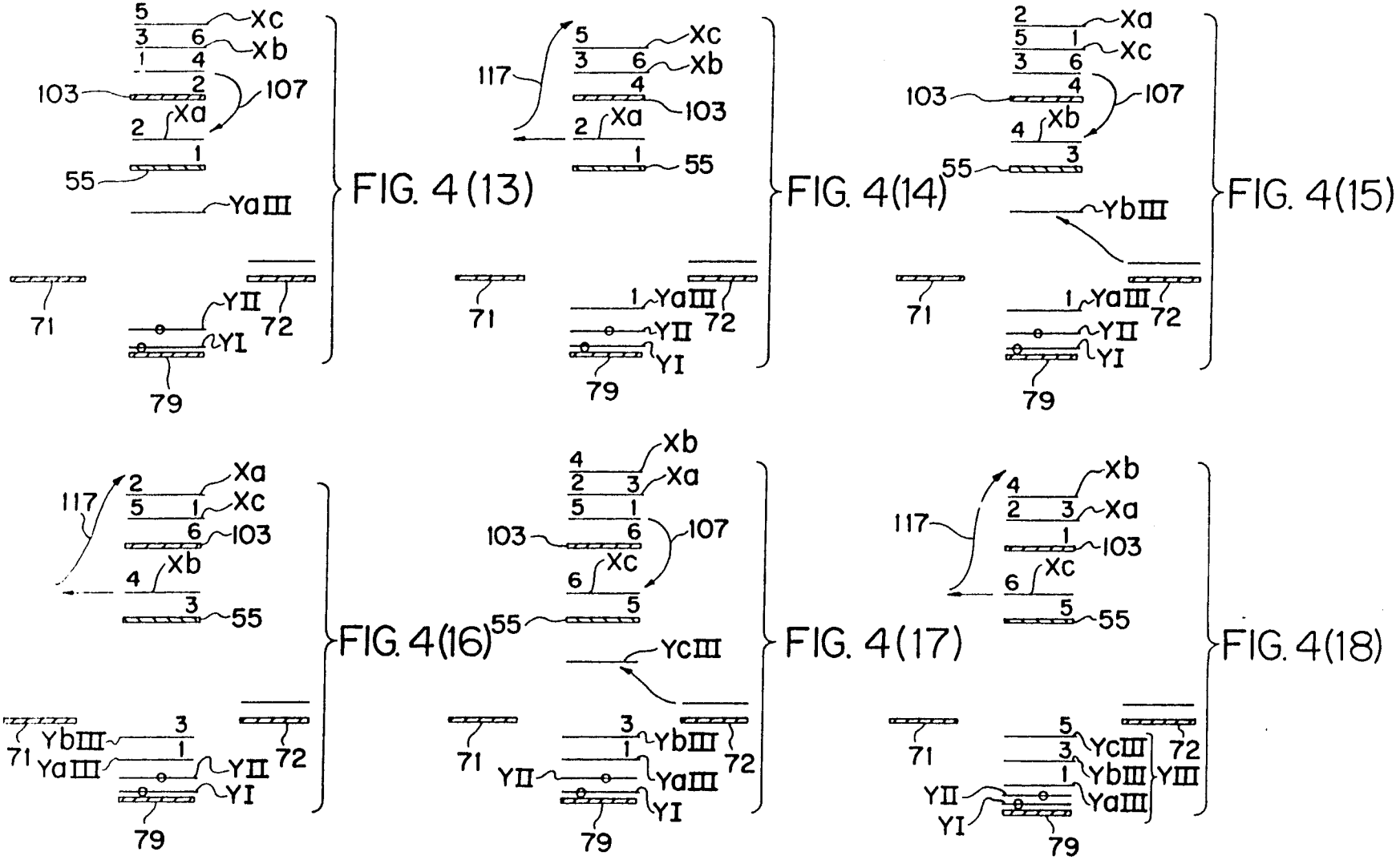
Figure 4:
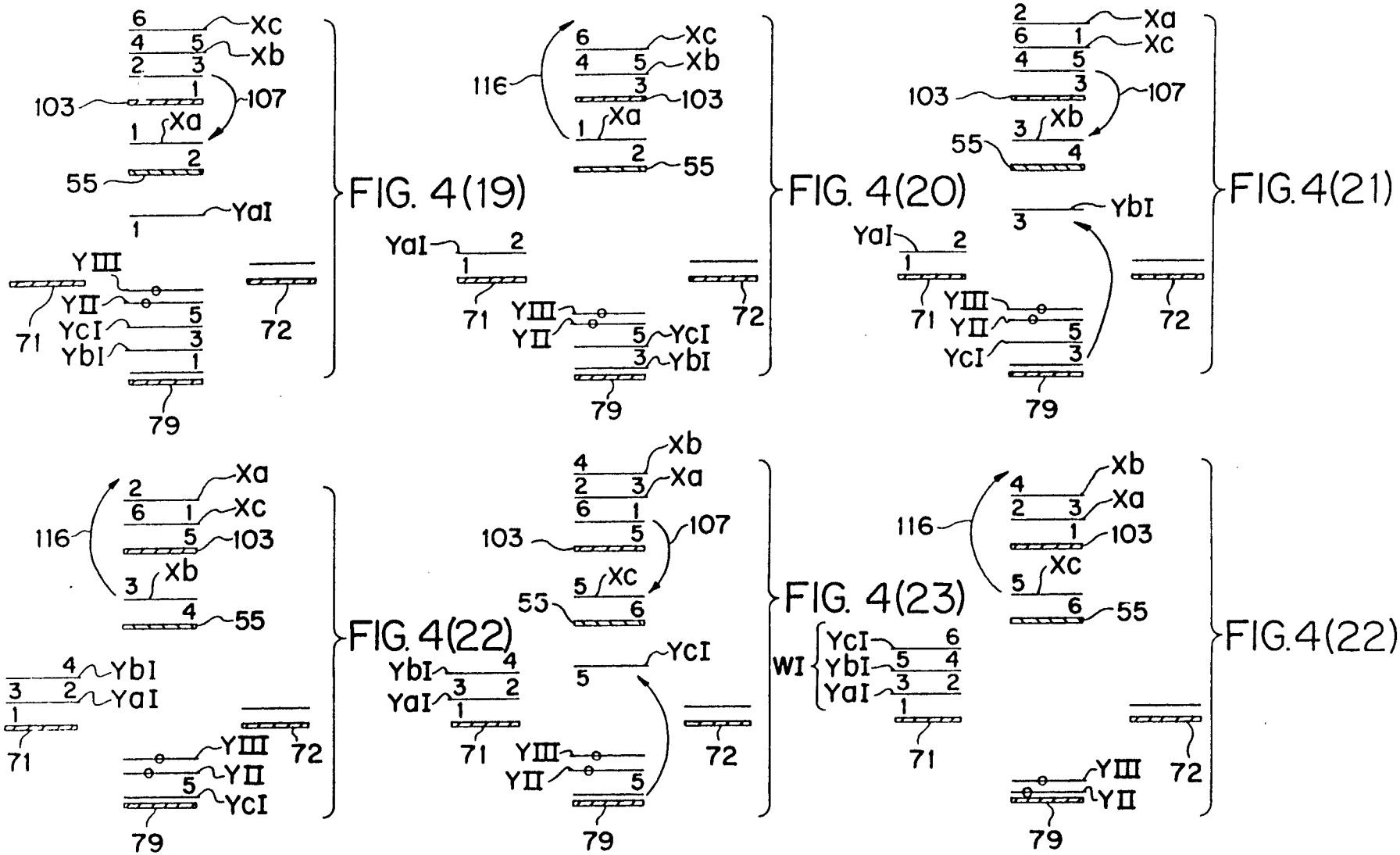
Figure 4:
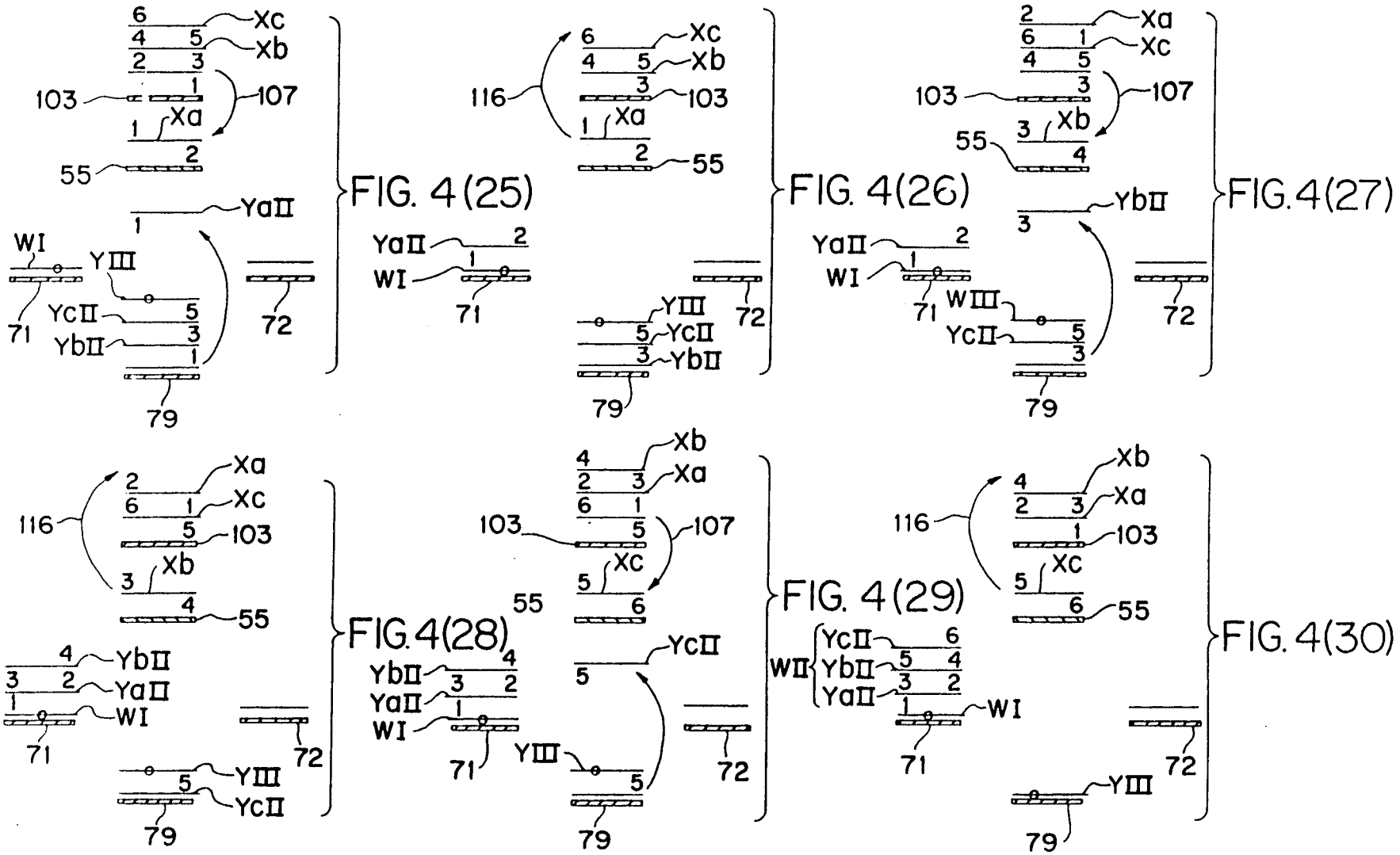
Figure 4:
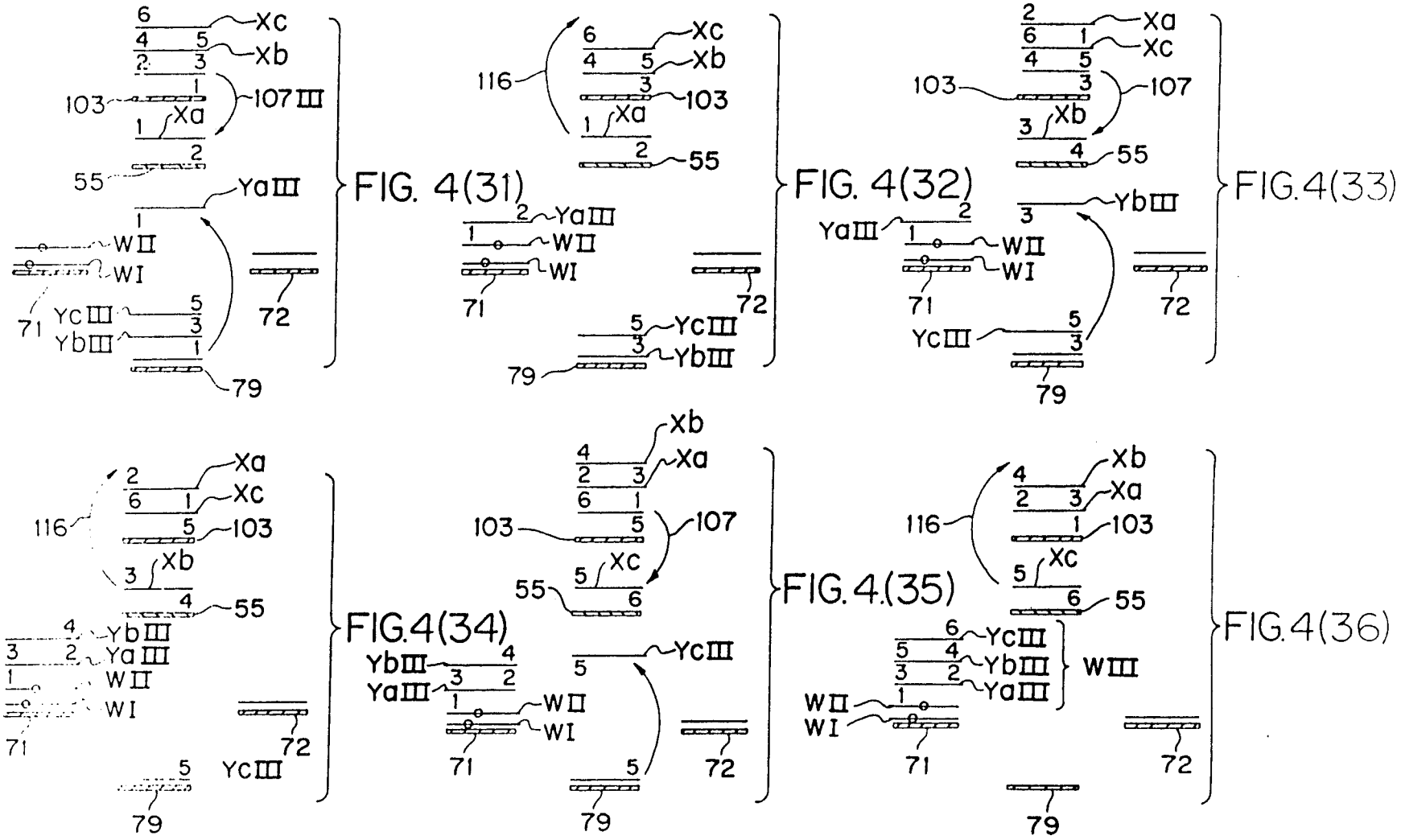

FIG. 4 is a simplified sectional view for explaining the copying action in one of the embodiments of the invention. This example is to explain the case of producing three duplicate copies WI, WII, WIII from three duplex original documents (merely called documents hereinafter) Xa, Xb, Xc. In the explanation to follow, when referring to the face side of the document X, the subscript "a" denotes the first document, "b" the second document, and "c" the third document. Similarly, when referring to the face side of the copying paper Y, subscripts "a", "b", "c" are attached. In the document X and copying paper Y, the same subscript means the relation between the face side of the document X being read and the face side of the copying paper Y on which this side is copied. The copying paper Y is also provided with subscripts "I", "II", "III", which denote the composition of the duplex copy W by the copying paper Y.

In the drawing, the page number is indicated on the surface of the document X, and the number showing the face of the document X copied on the surface when copying is completed is shown on the copying paper Y. When collectively referring to the document X and copying paper Y, the subscripts are omitted.

The documents X put on an original hopper 103 collated in the page sequence from bottom to top, with the first copying original face (odd-numbered page) set downward, are supplied into an exposure region 55 sequentially from the bottom, and the exposed documents X are returned to the original hopper 103 from the top.

First is explained the copying action of the first set of odd-numbered pages. As shown in FIG. 4 (1), the first document Xa runs through a second conveying route 108, and is supplied into the exposure region 55 while maintaining the same face-back relation, and the first page is copied on one side of the copying paper YaI supplied from the paper feeding tray 72. After the copying action, as shown in FIG. 4 (2), the copying paper YaI is stored in an intermediate tray 79 with the copied side upward, while the first document Xa is returned to the original hopper 103, in the inverted face-back state, through a third conveying route 116.

The second and third documents Xb, Xc, like the first document Xa, are supplied into the exposure region 55 through the second conveying route 108 as shown in FIG. 4 (3) to (6), and are returned to the original hopper 103 through the third conveying route 116. On one side of the copying papers YbI, YcI supplied from the paper feeding tray 72, the third and fifth pages are copied, and they are then stored in the intermediate tray 79. Therefore, when first copying of the odd-numbered pages is over, the documents X are stacked up on the original hopper 103, with the odd-numbered pages faced up, and a set of copying papers YI on which the odd-numbered pages are copied are stacked up on the intermediate tray 79.

Second copying action of odd-numbered pages is as follows. As shown in FIG. 4 (7), the first document Xa passes through the first conveying route 107, and is inverted in the face-back relation, and fed into the exposure region 55, and the first page is copied on one side of the copying paper YaII supplied from the paper feeding tray 72. After copying, as shown in FIG. 4 (8), the copying paper YaII is stored in the intermediate tray 79 with the copied side faced up, and the document Xa is returned to the original hopper 103, with the face-back relation inverted, after passing through the third conveying route 116.

The second and third documents Xb, Xc are, like the first document Xa, supplied into the exposure region 55 through the first conveying route 107 as shown in FIG. 4 (9) to (12), and are returned to the original hopper 103 through the third conveying route 116. On one side of the copying papers YbII, YcII supplied from the paper feeding tray 72, the third and fifth pages are copied, and they are stored in the intermediate tray 79. Therefore, after the second copying of the odd-numbered pages, the documents X are stacked up on the original hopper 103 with the odd-number pages faced up, and two sets of copying papers YI, YII on which the odd-numbered pages are copied are stacked up on the intermediate tray 79.

The third copying action of odd-numbered pages is explained below. As shown in FIG. 4 (13), the first document Xa is supplied into the exposure region 55, with the face-back relation inverted, through the first conveying route 107, and the first page is copied on one side of the copying paper YaIII supplied from the paper feeding tray 72. After copying, as shown in FIG. 4 (14), the copying paper YaIII is stored in the intermediate tray 79 with the copied side faced up, and the first document Xa is returned to the original hopper 103, while maintaining the face-back relation, through a fourth conveying route 117.

The second and third documents Xb, Xc are, like the first document Xa, supplied into the exposure region 55 through the first conveying route 107 as shown in FIG. 4 (15) to (18), and are returned to the original hopper 103 through the fourth conveying route 117. On one side of the copying papers, YbIII, YcIII supplied from the paper feeding tray 72, the third and fifth pages are copied, and they are stored in the intermediate tray 79. Therefore, after the third copying of the odd-numbered pages, the documents X are stacked on the original hopper 103 with the even-numbered pages faced up, and three sets of copying papers YI, YII, YIII on which the odd-numbered pages are copied are stacked up on the intermediate tray 79.

Next is shown the first copying action of the even-numbered pages. As shown in FIG. 4 (19), the first document Xa passes through the first conveying route 107, and is inverted in the face-back relation, and supplied into the exposure region 55, and the second page is copied on the other side of the copying paper YaI supplied from the intermediate tray 79. After copying, as shown in FIG. 4 (20), the copying paper YaI is discharged into the discharge tray 71 directly in the same face-back relation, and the first document Xa passes through the third conveying route 116 and is inverted into the original hopper 103 with the face-back relation inverted.

The second and third documents Xb, Xc are, like the first document Xa, supplied into the exposure region 55 through the first conveying route 107 as shown in FIG. 4 (21) to (24), and are returned to the original hopper 103 through the third conveying route 116. The fourth and sixth pages are copied on the other side of the copying papers YbI, YcI supplied from the intermediate tray 79, and they are discharged into the discharge tray 71. Therefore, after the first copying of the even-numbered pages, collated duplex copies WI are completed on the discharge tray 71. The documents X are stacked up on the original hopper 103 with the even-numbered pages faced up.

The second copying action of even-numbered pages is same as the first copying action of the even-numbered pages as shown in FIG. 4 (25) to (30). The first, second and third documents Xa, Xb, Xc are supplied into the exposure region 55 through the first conveying route 107, and are returned to the original hopper 103 by way of the third conveying route 116. Moreover, on the other side of the copying papers YaII, YbII, YcII supplied from the intermediate tray 79, the second page, fourth page and sixth pages are respectively copied, and they are discharged into the discharge tray 71. Therefore, after the second copying of the even-numbered pages, collated duplex copies WII are completed on the discharge tray 71, and the documents X are mounted on the original hopper 103 with the even-numbered pages faced up.

The third copying operation of the even-numbered pages is similar to the first copying action of even-numbered pages as shown in FIG. 4 (31) to (36). The first, second and third documents Xa, Xb, Xc are supplied into the exposure region 55 through the first conveying route 107, and are returned to the original hopper 103 through the third conveying route 116. On the other side of the copying papers YaIII, YbIII, YcIII supplied from the intermediate tray 79, the second page, fourth page and sixth pages are copies respectively, and they are discharged into the discharge tray 71. Therefore, after the third copying of the even-numbered pages, collated duplex copies WIII are completed on the discharge tray 71. The documents X are stacked up in the same state as initially piled up on the original hopper 103.

Thus, according to this embodiment, when recirculating the documents X into the exposure region 55, the second and fourth conveying routes 108, 117 for conveying while maintaining the face-back relation of the documents X are used only in the first and third copying actions of odd-numbered pages, and hence the number of times of changing the conveying direction of the documents X is decreased, and the feed speed of the documents X is increased. Besides, inversion of face-back relation for exposing the odd-numbered pages or the documents X is done when returning the documents X into the original hopper 103 after the final exposure of the odd-numbered pages, so that the number of times of recirculation of documents X is decreased. As a result, the time required for producing duplex copies in the copying apparatus 52 is shortened.

In other embodiment, for example, the documents X stacked up on the original hopper 103 may be supplied sequentially from the top, and returned to the original hopper 103 from the bottom. Furthermore, when storing the copying papers Y into the intermediate tray 79, instead of conveying up to the intermediate tray 79 by using the inverting route 78, a different tray may be installed, and the copying papers Y may be stacked up on this tray sequentially from bottom to top, and these copying papers Y may be moved as they are onto the intermediate tray 79.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of coping for obtaining collated duplex copies from a plurality of sets of originals by copying one side of duplex originals by a desired number of copies, the orginals supplied from and returned to a first location, and then copying the other side of duplex orginials by the same number of copies, comprising the steps of:

(a) supplying a plurality of sets of duplex originals in either top-bottom direction or bottom-top direction for copying;

(b) forwarding a first direction and exposing without inverting the face-back relation of the supplied duplex originals when copying a first set;

(c) after exposing returning a second direction by inverting the face-back direction of the duplex originals;

(d) supplying another set of duplex originals, inverting the face-back relation, and exposing;

(e) inverting the face-back relation and returning to a first position after exposing;

(f) supplying a final set of duplex originals, inverting the face-back relation of the supplied duplex originals, at the completion of exposing said final set of duplex originals, returning the originals to the first position without inverting the face-back relation so as to provide a copy of one side of the originals on one side of the copy paper; and (g) suppling said plurality of sets of duplex originals in the first direction for copying the other side of the duplex originals, inverting the face-back relation, exposing, and then inverting the face-back relation of the duplex originals after explosure to return the first location.

2. A copy apparatus for obtaining collated duplex copies from duplex originals the duplex originals having a face-back relation comprising:

means for storing a plurality of sets of duplex originals stacked up in a page sequence from bottom to top;

means for feeding originals one by one from the means for storing;

means for exposing the originals;

first conveying means for conveying the originals into an exposure region while maintaining the face-back relation, the first conveying means located between the means for feeding and exposure the means for exposing;

first inverting means for inverting the face-back relation of the orginals to convey them into the exposure regions, the first inverter means located between the means for feeding and the means for exposing;

second inverting means for inverting the face-back relation to return the originals exposed in the exposure region to a top of the means for storing;

second conveying means for returning the originals exposed in the exposure region to the top of the means for storing and maintaining the face-back relation;

means for feeding copying papers;

means for copying the exposed original images onto copying papers;

means for storing the copying papers after copying directly in the same face-back relation;

means for conveying the copying papers from the copying paper storing means into the copying means by inverting the face-back relation; and means for controlling so as to feed the copying papers from the copying paper feeding means when copying one side of the originals and store the copying papers after copying in the copying paper storing means, feed the copying papers from the copying paper storing means when copying the other side of the originals, lead the originals fed from the storing means into the explosure region through the first conveying means when copying a first set of one side of the originals and return the orginals after exposure to the storing means through the second inverting means, lead the originals fed from the storing means into the exposure region through the first inverting means when copying a final set of one side of the orginals and return the originals after exposure to the storing means through the second conveying means, and lead the originals fed from the storing means into the exposure region through the first inverting means when copying other than the first set and final set of one side of the originals when copying the other side of the originals and return the originals after exposure into the storing means through the second inverting means.

3. A copying apparatus according to claim 2, wherein the first conveying means comprises:

a first conveying member for conveying the originals from the paper feeding means, means for pooling the originals, and a second conveying member for conveying the originals from the original pooling means into the exposure region.

4. A copying apparatus according to claim 3, wherein the first conveying means further comprises:

means for orienting by guiding the originals from the paper feeding means into the original pooling means, and guiding the originals from the original pooling means into the exposure region.

5. A copying apparatus according to claim 2, wherein the first inverting means comprises:

means for guiding the originals from the paper feeding means by curving, and a pair of rollers for conveying the originals.

6. A copying apparatus according to claim 2, wherein the paper feeding means comprises:

means for orienting by guiding the originals from the storing means into the first conveying means or first inverting means.

7. A copying apparatus according to claim 2, wherein the second conveying means comprises:

a first conveying member for conveying the originals from the exposure region, means for pooling the originals, and a second conveying member for conveying the originals from the original pooling means into the storing means.

8. A copying apparatus according to claim 7, wherein the second conveying means further comprises:

means for orienting by guiding the originals from the exposure region into the original pooling means, and guiding the originals from the original pooling means into the storing means.

9. A copying apparatus according to claim 2, wherein the second inverting means comprises:

means for guiding the originals from the exposure region by curving, and a pair of rollers for conveying the originals.

10. A copying apparatus according to claim 2, wherein the copying apparatus comprises:

means for orienting by guiding the originals from the exposure region into the second conveying means or second inverting means.

11. A copying apparatus according to claim 2, wherein the copying means comprises:

means for converting the original image after exposure into a toner image and bringing it into a transfer region, means for conveying the copying paper into the transfer region for fixing the toner image, and means for discharging the copying paper from the transfer conveying region.

* * * * *